US009290892B2

(12) United States Patent
Vaske et al.

(10) Patent No.: US 9,290,892 B2
(45) Date of Patent: Mar. 22, 2016

(54) ASSEMBLY FOR END GATE

(71) Applicants: Michael R. Vaske, Knoxville, IA (US); Mark D. Prachar, Knoxville, IA (US)

(72) Inventors: Michael R. Vaske, Knoxville, IA (US); Mark D. Prachar, Knoxville, IA (US)

(73) Assignee: Weller, Inc., Knoxville, IA (US)

( * ) Notice: Subject to any disclaimer, the term of this patent is extended or adjusted under 35 U.S.C. 154(b) by 308 days.

(21) Appl. No.: 13/920,297

(22) Filed: Jun. 18, 2013

(65) Prior Publication Data

US 2014/0366664 A1 Dec. 18, 2014

(51) Int. Cl.

| | |
|---|---|
| ***F16H 21/44*** | (2006.01) |
| ***E01C 19/42*** | (2006.01) |
| *E04G 21/10* | (2006.01) |

(52) U.S. Cl.

CPC ..... *E01C 19/42* (2013.01); *E04G 21/10* (2013.01); *Y10T 74/18856* (2015.01)

(58) Field of Classification Search

USPC ..... 404/118

IPC ..... E01C 2301/20

See application file for complete search history.

(56) References Cited

U.S. PATENT DOCUMENTS

| | | | | | |
|---|---|---|---|---|---|
| 3,680,451 | A * | 8/1972 | Birtchet | E01C 19/187 | 404/104 |
| 5,344,254 | A * | 9/1994 | Sartain | E01C 19/48 | 404/104 |
| 5,924,819 | A * | 7/1999 | Breidenbach | E01C 19/42 | 404/104 |
| 6,238,134 | B1 * | 5/2001 | Sovik | E01C 19/4893 | 404/118 |
| 6,238,136 | B1 * | 5/2001 | Sovik | E01C 19/48 | 404/118 |
| 6,283,672 | B1 * | 9/2001 | Sovik | E01C 19/48 | 404/118 |
| 6,923,594 | B2 * | 8/2005 | Sovik | E01C 19/4893 | 404/104 |
| 8,491,221 | B1 * | 7/2013 | Hedin | E01C 19/48 | 404/104 |
| 8,591,142 | B2 * | 11/2013 | Mittleman | E01C 19/48 | 404/96 |
| 2014/0301782 | A1 * | 10/2014 | Mittleman | E01C 19/48 | 404/84.1 |

* cited by examiner

*Primary Examiner* — Gary Hartmann

(74) *Attorney, Agent, or Firm* — David M. Breiner; Christopher A. Presley

(57) ABSTRACT

Disclosed is an assembly that may be used with a machine, such as, but not limited to, a screed. In example embodiments, the assembly may include a first member, a second member adjacent to the first member, and a first actuator configured to rotate the second member with respect to the first member and transfer a biasing force to the second member. In example embodiments, the assembly may further include a second actuator configured to translate each of the first and second members.

19 Claims, 13 Drawing Sheets

ASSEMBLY FOR END GATE

BACKGROUND

1. Field

Example embodiments disclose an assembly. In example embodiments, the assembly may be used with various types of machines, such as, but not limited to, screeds.

2. Description of the Related Art

Screeds are mechanical devices used to construct various types of surfaces, for example, roadways. Screeds typically include assemblies, often called endgates, arranged at ends of the screeds. Conventional endgates are often fitted with wear shoes. In the conventional art, endgates typically include a plurality of independent adjustment means for adjusting a position of the wear shoe and a force on the wear shoe. In one conventional endgate, an elevation and orientation of an end gate is controlled by two independent means. In order to translate the wear shoe, the two independent adjustment means must be operated, for example, to raise or lower the wear shoe.

SUMMARY

Example embodiments disclose an assembly. In example embodiments, the assembly may be used with various types of machines, such as, but not limited to, screeds.

In accordance with example embodiments, an assembly may include a first member, a second member adjacent to the first member, and a first actuator configured to rotate the second member with respect to the first member and transfer a biasing force to the second member. In example embodiments, the assembly may further include a second actuator configured to translate each of the first and second members.

BRIEF DESCRIPTION OF THE DRAWINGS

Example embodiments are described in detail below with reference to the attached drawing figures, wherein.

DETAILED DESCRIPTION

Figure 1:
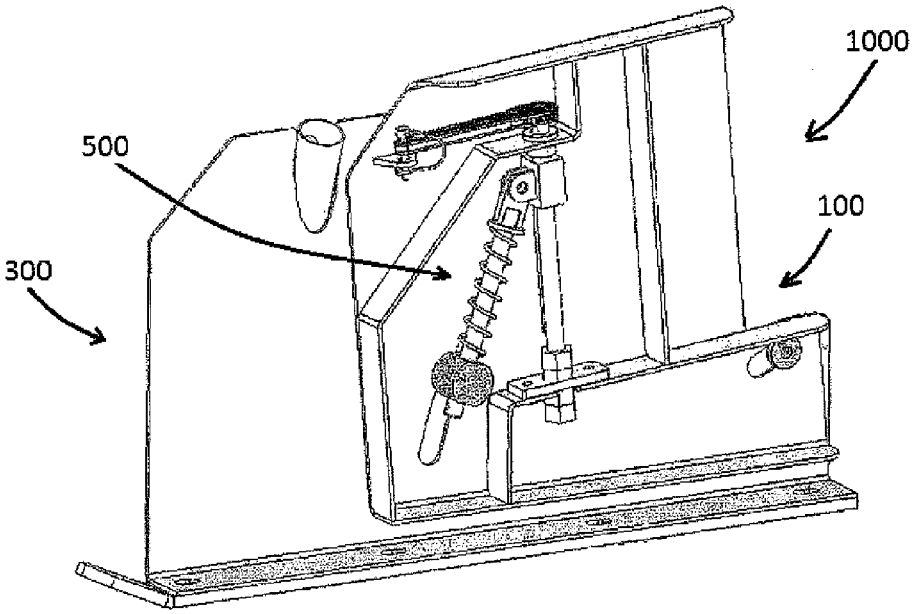
FIG. 1 is a view of an assembly in accordance with example embodiments.

Example embodiments will now be described more fully with reference to the accompanying drawings. Example embodiments are not intended to limit the invention since the invention may be embodied in different forms. Rather, example embodiments are provided so that this disclosure will be thorough and complete, and will fully convey the scope of the invention to those skilled in the art. In the drawings, the sizes of components may be exaggerated for clarity.

In this application, when an element is referred to as being "on," "attached to," "connected to," or "coupled to" another element, the element may be directly on, directly attached to, directly connected to, or directly coupled to the other element or may be on, attached to, connected to, or coupled to any intervening elements that may be present. However, when an element is referred to as being "directly on," "directly attached to," "directly connected to," or "directly coupled to" another element or layer, there are no intervening elements present. In this application, the term "and/or" includes any and all combinations of one or more of the associated listed items.

In this application, the terms first, second, etc. are used to describe various elements and components. However, these terms are only used to distinguish one element and/or component from another element and/or component. Thus, a first element or component, as discussed below, could be termed a second element or component.

In this application, terms, such as "beneath," "below," "lower," "above," "upper," are used to spatially describe one element or feature's relationship to another element or feature as illustrated in the figures. However, in this application, it is understood that the spatially relative terms are intended to encompass different orientations of the structure. For example, if the structure in the figures is turned over, elements described as "below" or "beneath" other elements would then be oriented "above" the other elements or features. Thus, the term "below" is meant to encompass both an orientation of above and below. The structure may be otherwise oriented (rotated 90 degrees or at other orientations) and the spatially relative descriptors used herein interpreted accordingly.

Example Embodiments are illustrated by way of ideal schematic views. However, example embodiments are not intended to be limited by the ideal schematic views since example embodiments may be modified in accordance with manufacturing technologies and/or tolerances.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments disclose an assembly. In example embodiments, the assembly may be used with various types of machines, such as, but not limited to, screeds.

FIG. 1 is a view of an assembly 1000 in accordance with example embodiments. In example embodiments, the assembly 1000 may include a first member 100 and a second member 300 which may be arranged adjacent one another. In example embodiments, the assembly 1000 may further include a first actuator 500 configured to rotate the second member 300 with respect to the first member 100. In example embodiments, the assembly 1000 may be usable for many purposes, such as, but not limited to, an end gate of a screed.

Figure 2A:
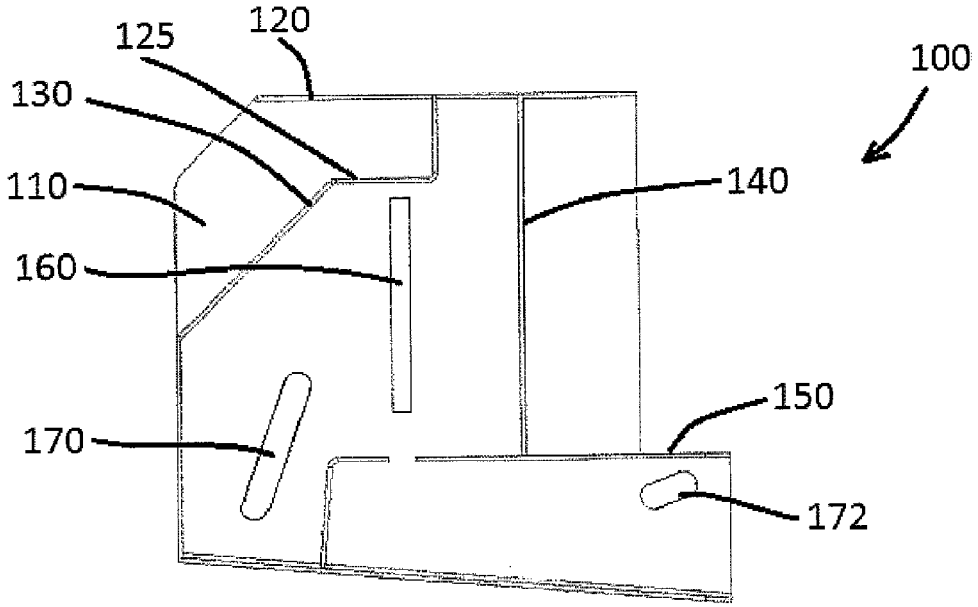
FIGS. 2A-2B are views of a first member in accordance with example embodiments.
Figure 2B:
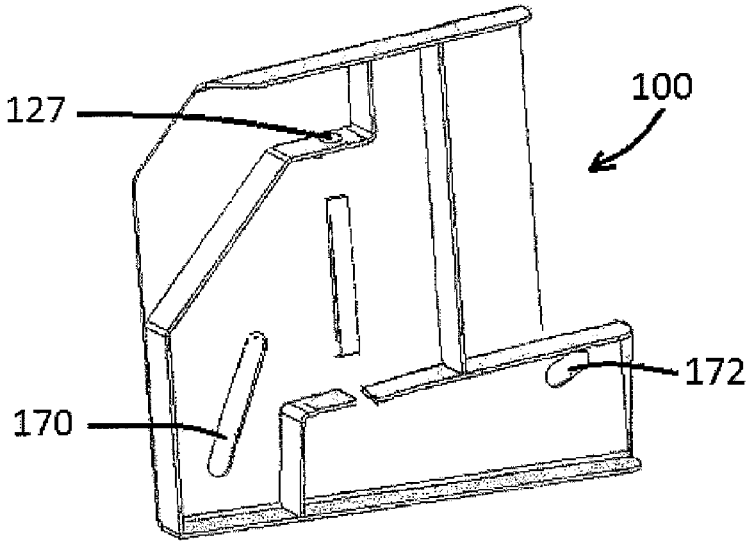

FIGS. 2A and 2B are views of the first member 100 in accordance with example embodiments. As shown in FIGS. 2A and 2B, the first member 100 may include a body 110 which may resemble a substantially flat plate. In example embodiments, several platforms may project from the body 110. For example, the first member 100 may include a first platform 125, a second platform 130, a third platform 140, and a fourth platform 150. In example embodiments, each of the first, second, third, and fourth platforms 125, 130, 140, and 150 may resemble plates which are perpendicular to the body 110. Example embodiments, however, are not limited thereto as the first, second, third, and fourth platforms 125, 130, 140, and 150 may resemble structures other than plates and are not required to be perpendicular to the body 110.

In example embodiments, the body 110 may include a protrusion 160. In example embodiments, the protrusion 160 may be configured to interface with a sleeve 570 of the first actuator 500 (shown at FIG. 5) to prevent the sleeve 570 from rotating. In example embodiments, the sleeve 570 may resemble a rectangular box, but may also resemble another structure such as, but not limited to, structures having a U, C, L, I or T-shaped cross section.

In example embodiments, the first member 100 may include a first aperture 170 and a second aperture 172. In example embodiments, each of the first and second apertures 170 and 172 may resemble elongated or slotted holes (as shown in the figures). Example embodiments, however, are not limited thereto. For example, in example embodiments the shapes of the first and second apertures 170 and 172 may resemble another shape such as, but not limited to, an arc, a circular, a rectangular, or an elliptical shape. As will be explained shortly, the first and second apertures 170 and 172 may allow structures to connect the first and second members 100 and 300 together and may allow the second member 300 to rotate relative to the first member 100.

Figure 3:
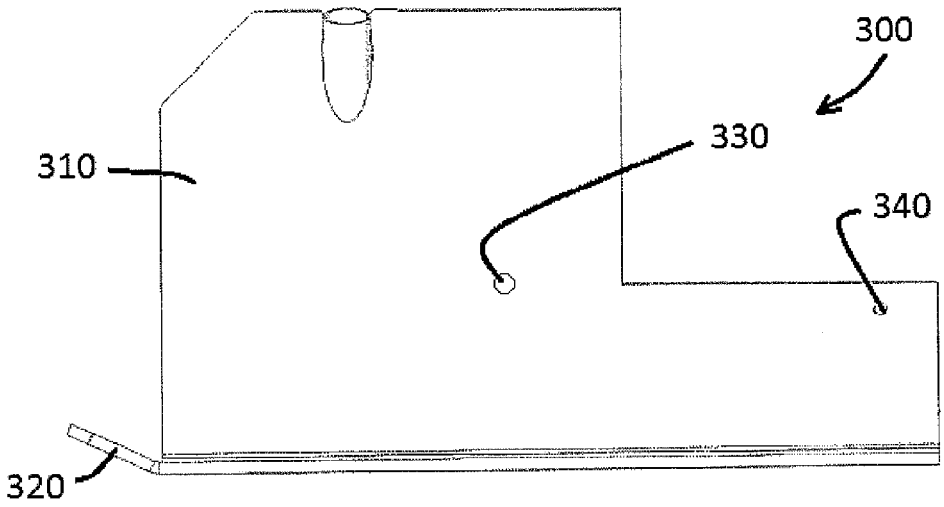
FIG. 3 is a view of a second member in accordance with example embodiments.

FIG. 3 is a view of the second structure 300 in accordance with example embodiments. As shown in FIG. 3, the second structure 300 may resemble a plate like structure having a body 310. In example embodiments, the body 310 may have structure 320, for example, a wear shoe, attached to a bottom of the body 310. In example embodiments, the structure 320 may be configured to contact a surface, for example, asphalt on a road, and may be used for edging. In example embodiments, the body 310 may include a first aperture 330 and a second aperture 340. In example embodiments, the first and second apertures 330 and 340 may have a spacing which allows them to align with the first and second apertures 170 and 172 of the first member 100.

Figure 4A:
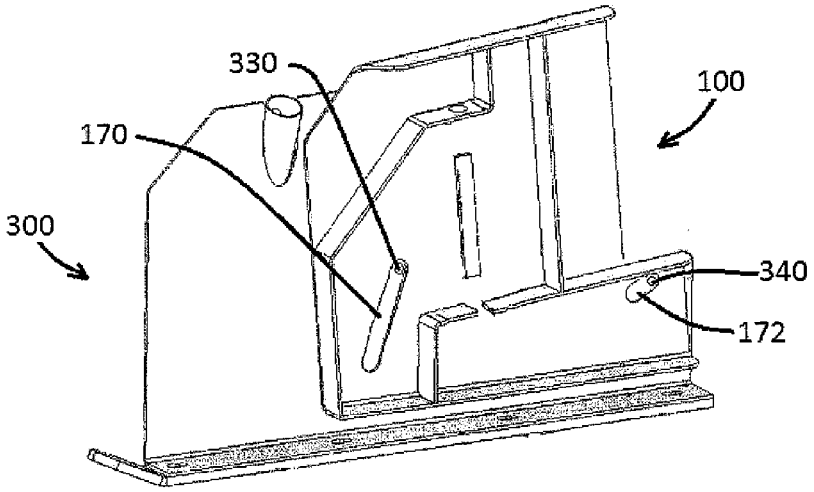
FIGS. 4A-4B are views of the first member adjacent to the second member in accordance with example embodiments.
Figure 4B:
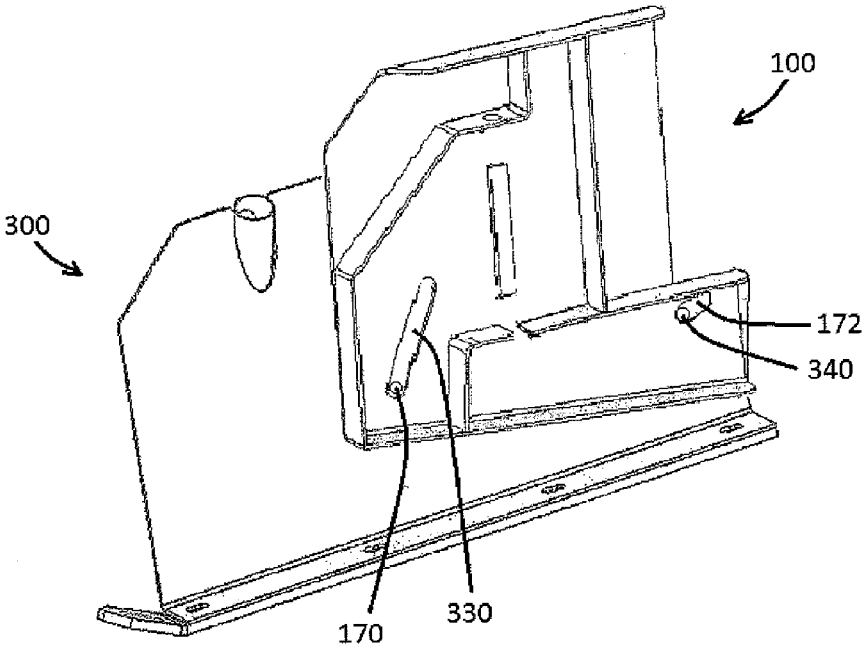

FIGS. 4A and 4B illustrate the first member 100 and the second member 300 arranged adjacent to one another. As shown in FIGS. 4A and 4B, the first and second members 100 and 300 may be arranged in a first position (see FIG. 4A) so that the first apertures 170 and 330 and the second apertures 172 and 340 of the first and second members 100 and 300 overlap one another. In example embodiments, the second member 300 may be rotated to a second position, as shown in FIG. 4B. During the rotation, the first apertures 170 and 330 and the second apertures 172 and 340 of the first and second members 100 and 300 remain overlapped with one another.

Figure 5:
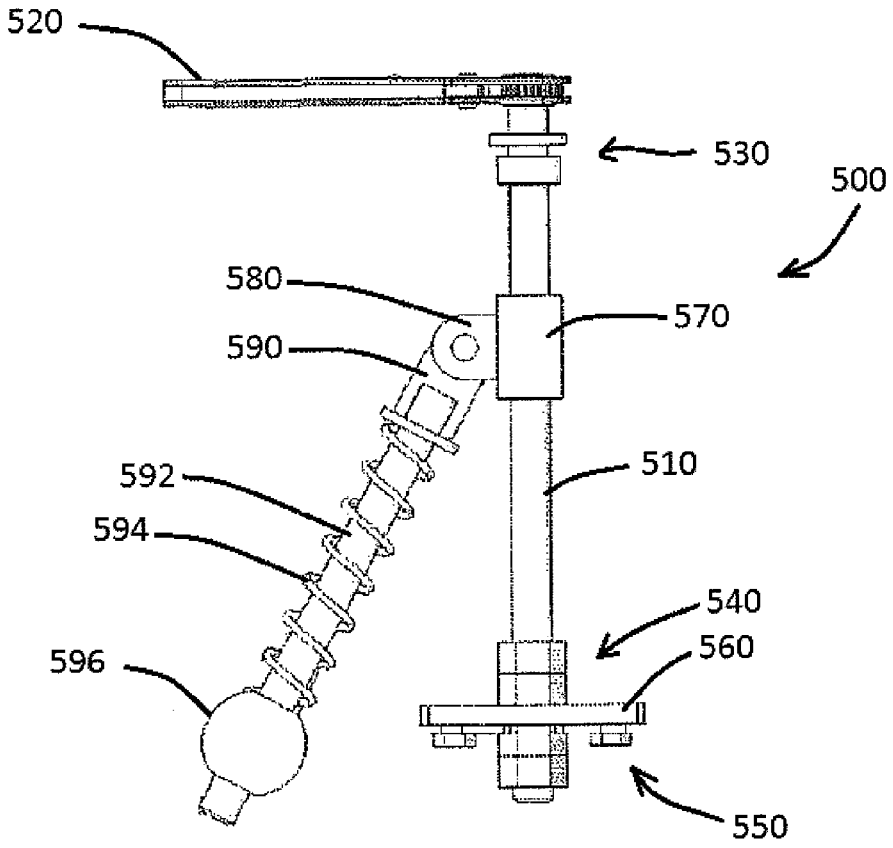
FIG. 5 is a view of an actuator in accordance with example embodiments.

FIG. 5 is a view of the first actuator 500 in accordance with example embodiments. As shown in FIG. 5, the first actuator 500 may include a cylindrical member 510, the sleeve 570 partially enclosing the cylindrical member 510, and a handle 520 configured to rotate the cylindrical member 510. In example embodiments, the cylindrical member 510 may include external threads. In example embodiments, the sleeve 570 may include a cylindrical hole having threads configured to engage the threads of the sleeve 570. Thus, in example embodiments, the sleeve 570 may travel along a length of the cylindrical member 510 as the cylindrical member 510 is rotated by the handle 520. For example, if the cylindrical member 510 is rotated counterclockwise the sleeve 570 may move in a first direction along the cylindrical member 510 and if the cylindrical member 510 is rotated clockwise the sleeve 570 may move in a second direction along the cylindrical member 510.

In example embodiments, the sleeve 570 may include a groove configured to interface with the protrusion 160 of the first member 100. For example, in the event the protrusion 160 has a rectangular cross-section, the groove may have a rectangular cross section into which the protrusion 160 may be inserted. Thus, the sleeve 570 may move along a length of the protrusion 160.

In example embodiments, the sleeve 570 may be attached to a rod 592. For example, in example embodiments, the sleeve 570 may include a tab 580 which may be pin-connected to a bracket 590 which in turn may be connected to the rod 592. In example embodiments, a biasing device 594, for example, a spring, may be configured to bias a first connector 596 along a length of the rod 592. For example, the biasing device 594 may be a coil spring wrapped around the rod 592 and arranged between the first connector 596 and the bracket 590. In example embodiments, the first connector 596 may include a cylindrical hole through which the rod 592 may be inserted. In example embodiments, the first connector 596 may move along the length of the rod 592 but may be biased into a position by the biasing device 594.

In example embodiments, the first connector 596 may be configured to attach the first member 100 to the second member 300. For example, the first connector 596 may include a cylindrical member that protrudes through each of the first apertures 170 and 330 and may be held in place by a pin or a nut. In example embodiments, a second connector 600 (see FIGS. 6A-6B) may also attach the first and second members 100 and 300 together. For example, the second connector may include a cylindrical member that passes through each of the second apertures 172 and 340 and may be held in place by a pin or a nut.

In example embodiments, the first actuator 500 may be held in place by a first fastening members such as plates, bracket, and/or screws. For example, in example embodiments, a first end of the cylindrical member 510 may pass through a hole 127 in the first platform 125 and held in place by a pair of securing members 530 which may resemble nuts or washers. A second end of the cylindrical member 520 may be inserted into a notch formed in the fourth platform 150 and may be secured in place by a first pair of securing members 540, a second pair of securing members 550, and a bracket 560 which may be fastened to the fifth platform 150, for example, by using screws or welds. In example embodiments, the first and second pair of securing members 540 and 550 may resemble washers or nuts.

In example embodiments, the manner in which the first actuator 500 is secured to the first member 100 is exemplary only and is not intended to limit example embodiments. For example, rather than providing a hole 127 in the first platform 125, the first platform 125 may include a notch into which a first end of the cylindrical member 510 may be inserted and the fourth platform 150 may include a hole (rather than a notch) into which as second end of the cylindrical member 510 may be inserted.

Figure 6A:
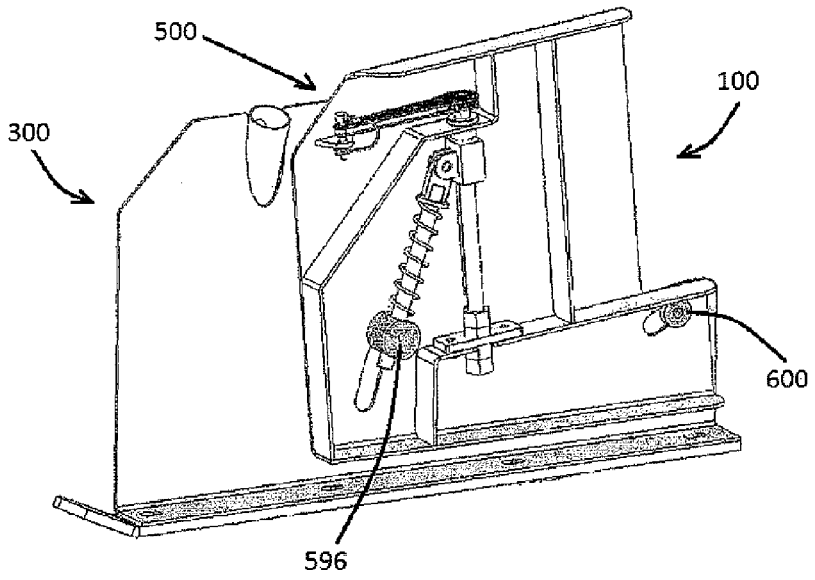
FIGS. 6A-6B are views of actuator displacing the second member with respect to the first member in accordance with example embodiments.
Figure 6B:
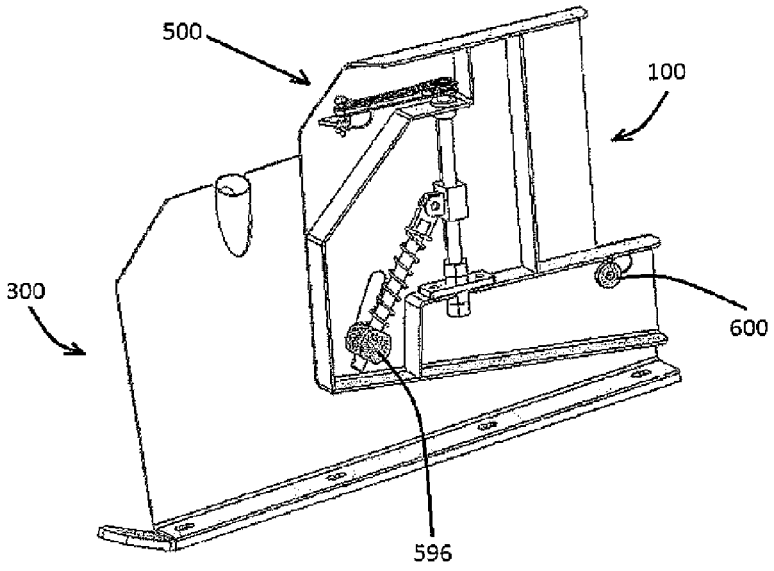

FIGS. 6A and 6B illustrate the first actuator 500 attached to the first member 100. As shown in FIGS. 6A and 6B, the first and second members 100 and 300 are secured to each other by the first and second connectors 596 and 600. As shown in FIG. 6A, the first connector 596 and the second connector 600 may be arranged in a first position wherein the first connector 596 and the second connector 600 are arranged at a rightmost position within their respective slots. In example embodiments, the handle 520 of the first actuator 500 may be turned to rotate the cylindrical member 510 which in turn causes the sleeve 570 to move along cylindrical member 510. As the sleeve 570 moves along the cylindrical member 510, the first connector 596 is pushed along the first aperture 170 and the second connector 600 is moved along the second aperture 172 causing the second member 300 to translate and rotate with respect to the first member 100 to assume the second configuration shown in FIG. 6B.

It is understood that example embodiments are not intended to be limited by the aforementioned description as several modifications of the example assembly 1000 are assumed to fall within the scope of the invention. For example, rather than having a second member 300 with a first and second aperture 330 and 340, the second member 300 may have posts arranged where the first and second apertures 330 and 340 are illustrated and the posts may protrude through the first and second apertures 170 and 172 of the first member 100. The posts may be inserted into or connected to the first and second connectors 596 and 600. For example, each of the first and second connectors may resemble cylinders having an internally threaded hole which may be configured to receive the posts that may be protruding from the second member 300. In this latter nonlimiting example embodiments, the posts may be threaded. Thus, the first and second connectors 596 and 600 may be screwed onto their respective posts.

Figure 7:
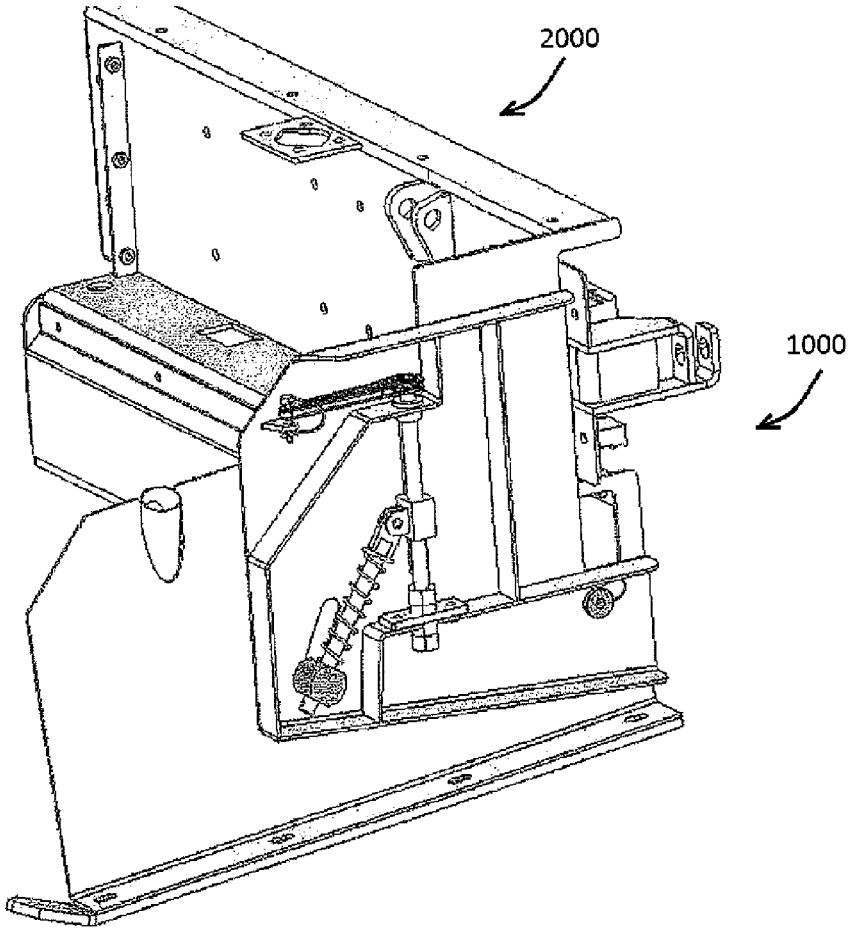
FIG. 7 is a view of a screed using the assembly as an endgate in accordance with example embodiments.

In example embodiments, the assembly 1000 may have several uses. For example, as shown in FIG. 7, the assembly 1000 may fit at an end of a screed 2000 and thus may be used in devices that form concrete and/or asphalt structures. In example embodiments, because of the first connector 596 may move along the rod 592, some flexibility is imparted to the assembly 1000. Thus, in example embodiments, the assembly 1000 may be able to absorb shock that may be imparted to it during use as an end gate of a screed 2000.

Figure 8:
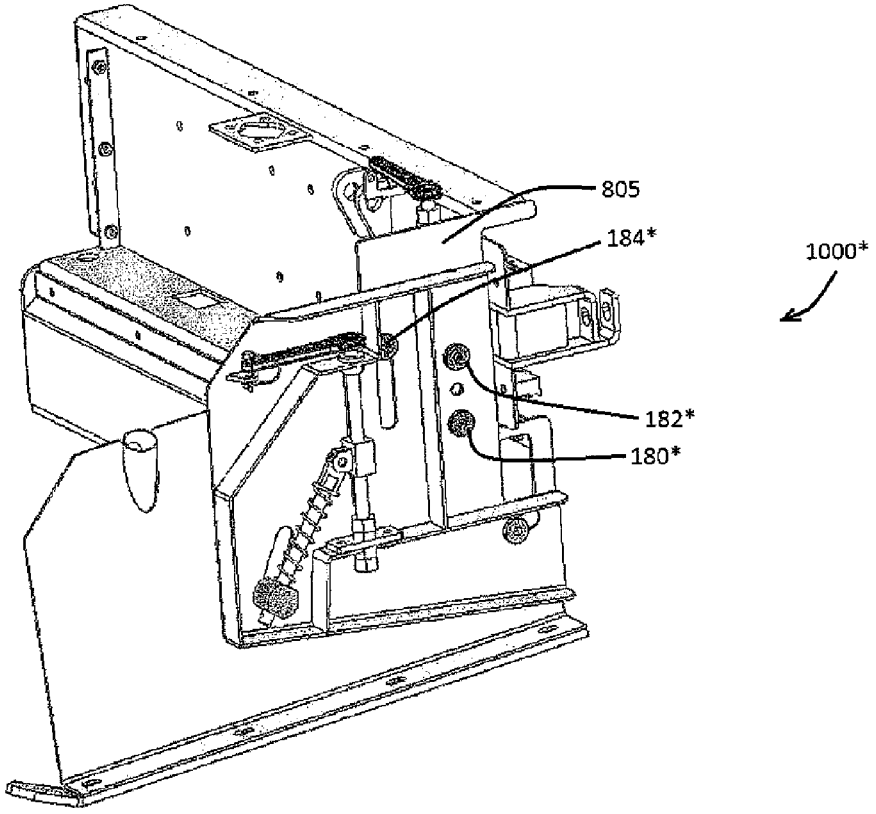
FIG. 8 is a view of an assembly in accordance with example embodiments.

FIG. 8 is a view of a modified assembly 1000* fitted on an end of a screed 2000 in accordance with example embodiments. In example embodiments, the modified assembly 1000* may be substantially the same as the assembly 1000, thus, only the differences will be pointed out with particularity.

Figure 9:
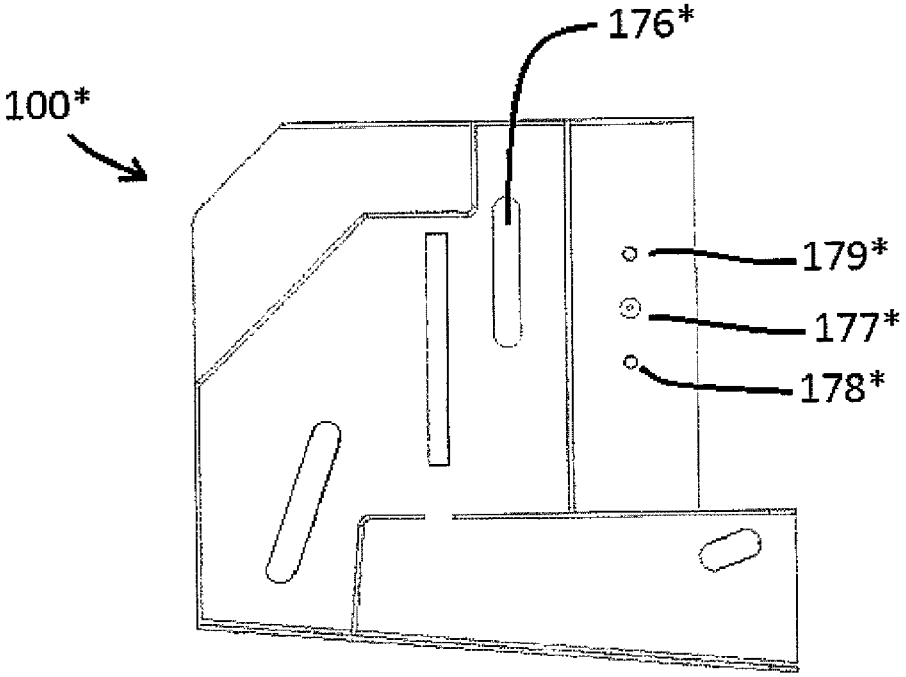
FIG. 9 is a view of a first member in accordance with example embodiments.
Figure 10:
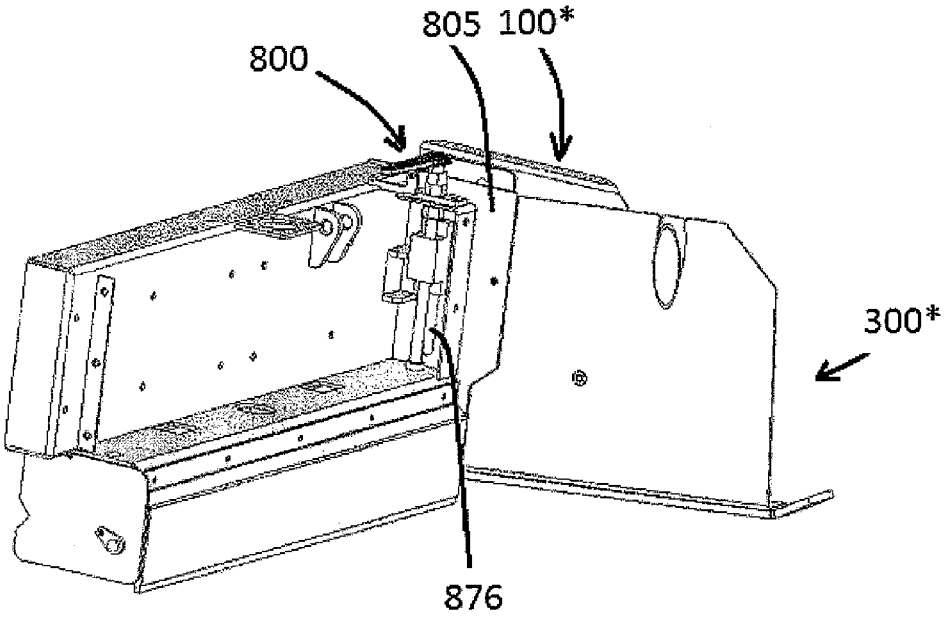
FIG. 10 is a view of a screed using the assembly as an endgate in accordance with example embodiments.

Referring to FIG. 9, the modified assembly 1000* may include a first member 100* which may be substantially the same as the first member 100. However, as shown in FIG. 9, the first member 100* may include a third aperture 176* as well as fourth and fifth apertures 178* and 179*. In example embodiments, the third aperture 176* may be configured to accommodate a connector 184*(see FIG. 8) which may pass through the third aperture 176* to connect to a member 805 (see FIG. 10), for example a back plate, which may be rigidly connected to the screed 2000. In example embodiments, the fourth and fifth apertures 178* and 179* may be configured to receive fourth and fifth connectors 180* and 182* which may pass through the first member 100* to connect the first member 100* to a second actuator 800 that may be attached to the screed 2000. In example embodiments, the member 805 may include a slot 876 through which the fourth and fifth connectors 180* and 182* may pass so that the fourth and fifth connectors 180* and 182* may attach to a sleeve 830 of the second actuator 800.

Figure 11:
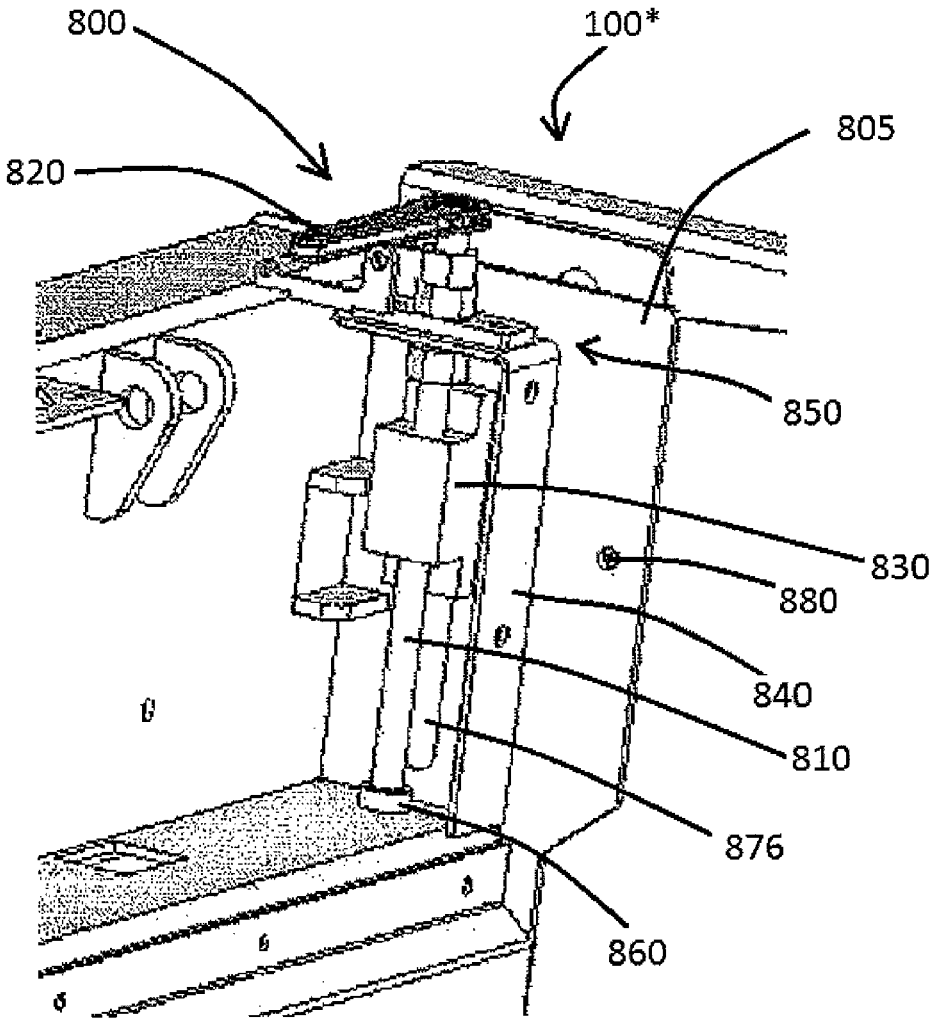
FIG. 11 is a view of an actuator in accordance with example embodiments.

Referring to FIG. 11, the second actuator 800 is illustrated as being comprised of a cylindrical member 810, a sleeve 830, and a handle 820. In example embodiments, the cylindrical member 810 may be a threaded member and the sleeve 830 may include a cylindrical hole through which the cylindrical member 810 may pass. In example embodiments, the cylindrical hole of the sleeve 830 may include threads configured to engage the threads of the cylindrical member 810. Thus, in example embodiments, as the handle 820 is turned, the cylindrical member 810 may rotate which in turn causes the sleeve 830 to move along a length of the cylindrical member 810.

In example embodiments, the screed 2000 may include a platform 840 which may include a hole on a top portion of the platform 840. In example embodiments, the cylindrical member 810 may pass through the hole and to a support member 860. In example embodiments, the cylindrical member 810 may be held in place by fastening members 850 which may fasten the cylindrical member 810 to the platform 840. In example embodiments, the fastening members 850 may resemble a plate which may be fastened to the platform 840 by a plate which may in turn be fixed to the platform 840 by a conventional means such as, but not limited to, welding or screws. In example embodiments, the fastening members 850 may be configured to prevent the cylindrical member 810 from moving vertically.

In example embodiments, the third and fourth fasteners 180* and 182* may pass through an aperture 876 that may be in the member 805 of the screed 2000. In example embodiments, the third and fourth fasteners 180* and 182* may pass through the fourth and fifth holes of the first member 100* to connect the sleeve 830 to the first member 100*. In example embodiments, as the handle 820 is turned, the cylindrical member 810 turns causing the sleeve 830 to move along the cylindrical member 810. Because the first member 100* may be attached to the sleeve 830, the sleeve 100* may move along a length of the cylindrical member 810 as the sleeve 830 moves along the cylindrical member 810.

Example embodiments provide an example of an assembly. In example embodiments, the assembly may be comprised of a first member (for example, 100 or 100*), a second member adjacent to the first member (for example, 300 or 300*), a first actuator 500 configured to rotate the second member (for example, 300 or 300*) with respect to the first member (for example, 100 or 100*) and transfer a biasing force to the second member (for example, 300 or 300*). In example embodiments, biasing force may be generated by a biasing member/device 594 which may be, but is not limited to, a coil spring.

In example embodiments, the first member (100 or 100*) may include an elongated hole (for example, 170) and a second hole (for example 172) which may also be an elongated hole.

In example embodiments, the assembly may further include a first connector (for example, 596) connecting the first member (100 or 100*) to the second member (for example, 300 or 300*) and a second connector (for example 600) connecting the first member (100 or 100*) to the second member (300 or 300*), wherein the first connector (for example, 596) is configured to slide along the elongated hole (for example, 170).

In example embodiments, the first actuator 500 may be configured to attach to the first connector (for example, 596). In example embodiments, first actuator 500 may include a rod (for example, 592) and the first connector (for example, 596) may be configured to slide along the rod (for example, 592). In example embodiments, the first actuator 500 may include a biasing member (for example, 594) configured to bias the first connector (for example, 596) and may also include a handle (for example, 520) operatively connected to the first connector (for example, 596). In example embodiments, the first actuator 500 may further include a cylindrical member 510 and a sleeve 570 engaged with the cylindrical member 510 and the rod 592.

In example embodiments, the assembly may further include a second actuator (for example, 800) configured to move the first member (for example, 100*) and the second member (for example 300*) in a first direction. The assembly may also include a third connector (for example, one of 180* and 182*) connecting first member (for example, 100*) to the second actuator (for example, 800*). In example embodiments, the second actuator (for example, 800) may include a handle (for example, 820) operatively connected to the third connector (for example one of 180* and 182*). In example embodiments, the assembly may further include a backplate (for example, 805) with an elongated hole (for example, 876) through which the third connector may pass. In example embodiments, the second actuator 800 may include a cylindrical member 810 and a sleeve 830 engaged with the cylindrical member and the third connector.

The assemblies of example embodiments provide several advantages over the prior art. For example, in example embodiments, the assemblies may include a wear shoe which may be translated in a first or second direction by operating only a single actuator whereas prior art assemblies require an operation of two or more actuators to move a shoe. Furthermore, in example embodiments, an angle of a wear shoe may be adjusted by operating a single actuator whereas prior art assemblies typically require adjusting an angle of the wear shoe by operating two or more actuators.

Figure 12:
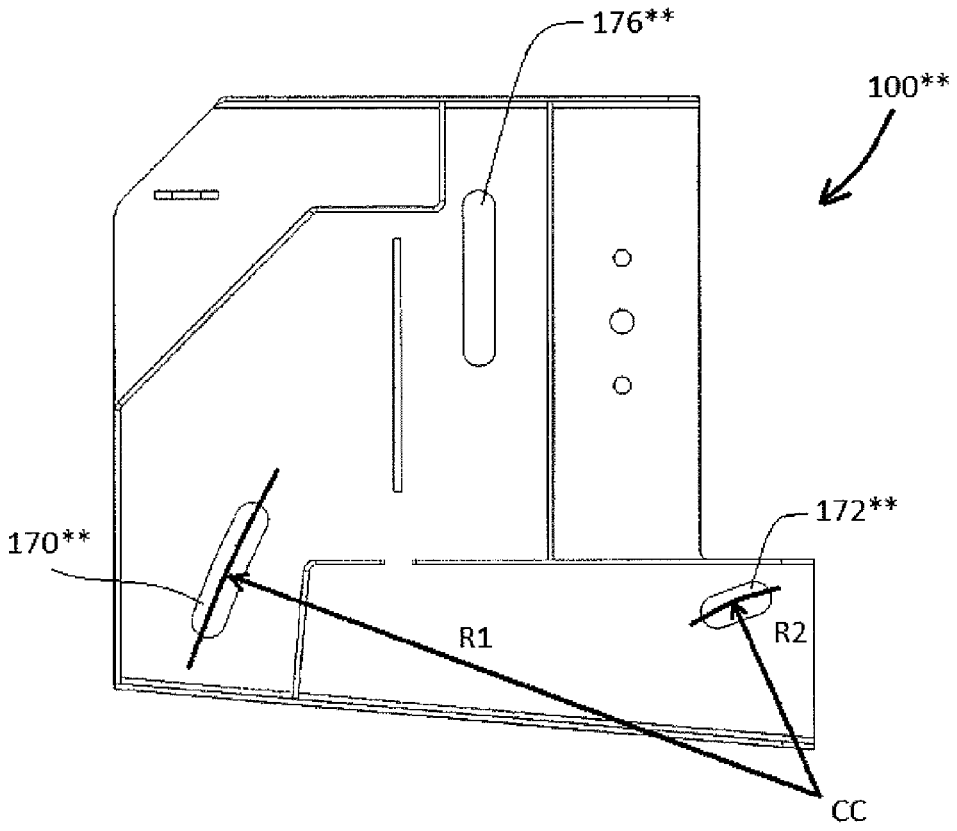
FIG. 12 is a view of a first member in accordance with example embodiments.

FIG. 12 is another example of a first member 100 in accordance with example embodiments. In example embodiments, the first member 100** may be substantially identical to the first members 100 and 100*. For example, in example embodiments, the first member 100** may have a first aperture 170** and a second aperture 172**. However, in the first member 100** of FIG. 12, the first aperture 170** and the second aperture 172** are arc shaped slots. The first aperture 170**, for example, may have a substantially constant curvature with a radius of curvature of R1. The second aperture 172** may also have a substantially constant curvature with a radius of curvature of R2. In example embodiments, the center of curvature CC for each of the first and second apertures 170** and 172** may be coincident. Thus, in example embodiments, the first member 100* may rotate about the center of curvature CC of each of the first and second apertures 170** and 172**. Example embodiments, however, are not intended to be limited by the above features. For example, each of the first and second apertures 170** and 172**** may not have constant curvatures and may not have a common center of curvature.

Figure 13:
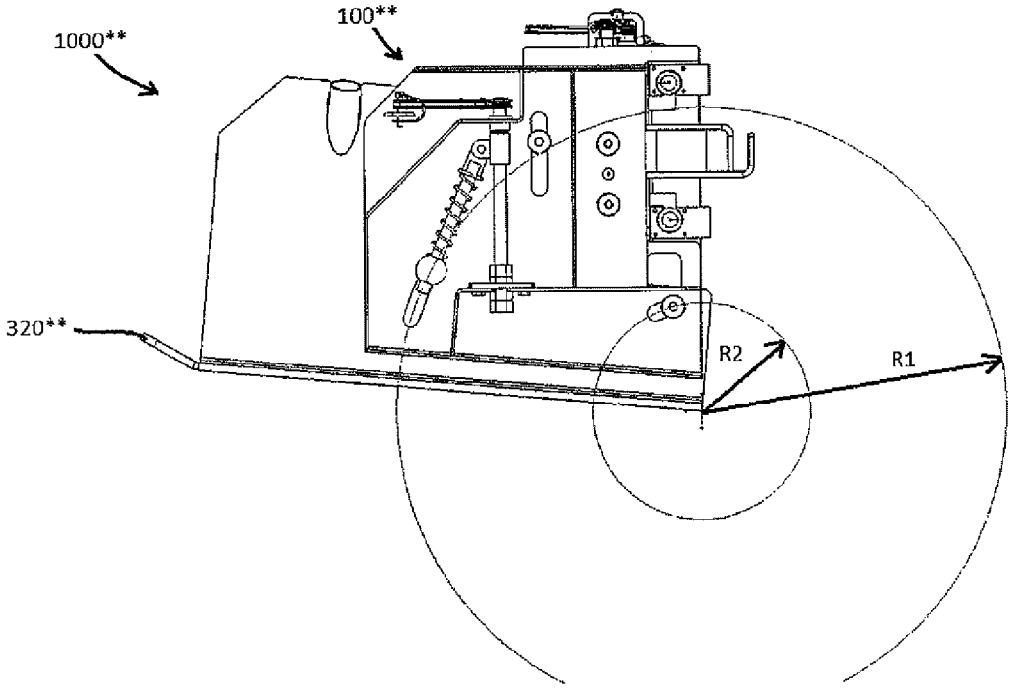
FIG. 13 is a view of an assembly in accordance with example embodiments.

FIG. 13 is a view of an assembly 1000 in accordance with example embodiments. In example embodiments, the assembly 1000** of example embodiments may be substantially similar to the assembly 1000 and 1000* except that the assembly 1000** includes the first member 100** rather than the first member 100 and 100*. In the assembly 1000** of FIG. 13, the center of curvature of the first aperture 170** and 172** may be coincident and may coincide with a corner of the structure 320**, which may be, but is not limited to, a wear shoe. Thus, in example embodiments, the first member 100** of the assembly 1000** may rotate about a corner of the structure 320****.

In example embodiments, the assembly 1000 may attach to a screed in a manner similar to the assemblies 1000 and 1000***, thus, a detailed description thereof is omitted for the sake of brevity.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What we claim is:

1. An end gate adjustable in rotation and height, the end gate comprising:

a first member;

a second member adjacent to the first member;

a first actuator configured to rotate the second member with respect to the first member and transfer a biasing force to the second member; wherein the first member includes an elongated arc shaped hole and a second arc shaped hole; and a center of curvature of each of the first and second arc shaped holes is coincident.

2. The end gate of claim 1, further comprising:

a first connector connecting the first member to the second member; and a second connector connecting the first member to the second member, wherein the first connector is configured to move along the elongated hole.

3. The end gate of claim 2, wherein the first actuator is configured to attach to the first connector.

4. The end gate of claim 3, wherein the first actuator includes a rod and the first connector is configured to slide along the rod.

5. The end gate of claim 3, wherein the first actuator includes a biasing member configured to bias the first connector.

6. The end gate of claim 3, wherein the first actuator includes a handle operatively connected to the first connector.

7. The end gate of claim 3, wherein the first actuator includes a cylindrical member and a sleeve engaged with the cylindrical member and the rod.

8. The end gate of claim 1, further comprising:

a second actuator configured to move the first member and the second member in a first direction; and a third connector connecting first member to the second actuator.

9. The end gate of claim 8, wherein the second actuator includes a handle operatively connected to the third connector.

10. The end gate of claim 9, further comprising:

a backplate with an elongated hole through which the third connector passes.

11. The end gate of claim 10, wherein the second actuator includes cylindrical member and a sleeve engaged with the cylindrical member and the third connector.

12. A screed comprising:

the end gate of claim 1.

13. The screed of claim 12, wherein the first member includes a first slotted hole and a second slotted hole.

14. The screed of claim 13, further comprising:

a first connector connecting the first member to the second member;

a second connector connecting the first member to the second member; and a third connector connecting the first member to the second actuator, wherein the first connector is configured to slide along the elongated hole, the second connector is configured to slide in the second hole, and the third connector is configured slide in a hole arranged in a backplate between the first member and the second actuator.

15. An assembly comprised of:

a first member having a first elongated hole;

a second member adjacent to the first member;

a first actuator configured to rotate the second member with respect to the first member and transfer a biasing force to the second member;

a second actuator configured to move the first member and the second member in a first direction;

a first connector connecting the first member to the second member, the first connector being configured to move along the first elongated hole;

a second connector connecting the first member to the second member;

a third connector connecting first member to the second actuator.

16. The assembly of claim 15, wherein the first actuator is configured to attach to the first connector.

17. The assembly of claim 15, wherein the first actuator includes a rod and the first connector is configured to slide along the rod.

18. The assembly of claim 15, wherein the first actuator includes a biasing member configured to bias the first connector.

19. The assembly of claim 15, wherein the first actuator includes a handle operatively connected to the first connector and the second actuator includes a handle operatively connected to the third connector.

* * * * *